US007878359B1

(12) United States Patent
Ko

(10) Patent No.: US 7,878,359 B1
(45) Date of Patent: Feb. 1, 2011

(54) TRASH CAN WITH A DEODORIZING MECHANISM

(76) Inventor: Wen-Hsiung Ko, No.9, Lane 339, Beiyang Rd., Fengyuan City (TW) 420

( * ) Notice: Subject to any disclaimer, the term of this patent is extended or adjusted under 35 U.S.C. 154(b) by 0 days.

(21) Appl. No.: 12/718,981

(22) Filed: Mar. 7, 2010

(51) Int. Cl.
*B65D 25/00* (2006.01)

(52) U.S. Cl. ..... 220/87.2; 220/908.2

(58) Field of Classification Search ..... 206/204; 220/87.1, 87.2, 908, 908.1, 908.2; 422/5, 422/187
See application file for complete search history.

(56) References Cited

U.S. PATENT DOCUMENTS 2,281,630 A * 5/1942 Southard ..... 220/87.2
2,460,554 A * 2/1949 Vogel ..... 220/87.2
2,652,173 A * 9/1953 Farrell ..... 220/87.2
6,814,249 B2 * 11/2004 Lin ..... 220/87.1
7,033,039 B2 * 4/2006 Lin ..... 220/908
7,086,569 B2 * 8/2006 Stravitz ..... 220/908
7,516,865 B1 * 4/2009 Pierre ..... 220/87.1
2006/0081632 A1 * 4/2006 Shieh ..... 220/87.1
2008/0175751 A1 * 7/2008 Sun et al. ..... 422/5

* cited by examiner

*Primary Examiner*—Luan K Bui
(74) *Attorney, Agent, or Firm*—Wang Law Firm; Li K. Wang

(57) ABSTRACT

A trash can with a deodorizing mechanism comprises a body having an opening formed at the top of the body, a lid pivotally coupled to the top of the body for performing an opening or closing movement, and a deodorizing mechanism installed on the body and including a bottle and a nozzle. The nozzle includes an actuating element propped by an elastic body to provide a restoring elasticity, such that if the lid is closed and covered onto the opening, the actuating element will be pressed by the lid to compress the elastic body, and the nozzle will suck a deodorant stored in the bottle and spray the deodorant towards the interior of the body. If the lid is closed and covered onto the opening, the elastic body will be compressed to slow down the closing movement of the lid.

6 Claims, 6 Drawing Sheets

TRASH CAN WITH A DEODORIZING MECHANISM

BACKGROUND OF THE INVENTION

1. Field of the Invention

The present invention relates to a trash can structure, and more particularly to a trash can with a deodorizing mechanism having a function of removing odors automatically or manually and an effect of slowing down an opening or closing movement of the trash can.

2. Description of the Related Art

Trash can is a necessary item for daily life. However, there is a long existing problem about the stingy smell coming out from a trash can after trashes have been dumped and stored in the trash can for some time. Therefore, traditional trash cans not just affect the quality of environment only, but also jeopardize human health.

In view of the foregoing shortcoming, the inventor of the present invention based on years of experience in the related industry to conduct extensive researches and experiments, and finally developed an opening and closing device for a trash can in accordance with the present invention to overcome the problem.

SUMMARY OF THE INVENTION

Therefore, it is a primary objective of the present invention to overcome the aforementioned shortcoming and deficiency of the prior art by providing a trash can with a deodorizing mechanism having a function of spraying an deodorant when a trash can is opened or closed, as well as providing an effect of slowing down an opening or closing movement of the trash can.

Another objective of the present invention is to provide a trash can with a deodorizing mechanism capable of removing odors automatically or manually.

A further objective of the present invention is to provide a trash can with a deodorizing mechanism having an effect of removing odors of trash in the trash can.

To achieve the foregoing objective, the present invention provides a trash can with a deodorizing mechanism, comprising:

a body, having a containing space therein, and an opening formed at the top of the body and interconnected to the containing space;

a lid, having a pivot portion pivotally coupled to an appropriate position at the top of the body and capable of opening or closing the opening of the body, and a pressing element installed to the lid;

a deodorizing mechanism, mounted onto the body and comprised of a bottle containing a deodorant and a nozzle installed to the bottle, and the nozzle including an actuating element for controlling an operation of the nozzle, and the actuating element propped by an elastic body for providing a restoring elasticity, such that if the lid is closed and covered onto the opening of the body, the pressing element will press the actuating element to compress the elastic body, and the nozzle will suck the deodorant in the bottle and spray the deodorant towards the containing space of the body, and if the lid is closed and covered onto the opening of the body, the actuating element will compress the elastic body to slow down the closing movement of the lid.

In addition, the pressing element is comprised of a bushing installed in the lid, and a press rod passed into the bushing, and the bushing includes a long slot section and a short slot section formed thereon, and an end of the press rod is extended to the exterior of the lid to form a pressing end, and another end is defined as a pressed end, and the press rod includes a protrusion selectively passed into the long slot section or the short slot section of the bushing, thereby if the protrusion of the press rod is selectively passed into the short slot section of the bushing and the lid is closed and covered onto the opening of the body, the pressed end of the press rod will synchronously press the actuating element, and the nozzle will suck the deodorant stored in the bottle and spray the deodorant towards the containing space of the body, and if the protrusion of the press rod is selectively passed into the long slot section of the bushing and after the lid is closed and covered onto the opening of the body, the pressing end of the press rod can be pressed manually to press the actuating element, such that the nozzle can suck the deodorant stored in the bottle and spray the deodorant towards the containing space of the body. If the protrusion of the press rod is selectively passed into the long slot section of the bushing and after the lid is closed and covered onto the opening of the body, the pressing end of the press rod can be pressed manually to press the actuating element, such that the nozzle can suck the deodorant stored in the bottle and spray the deodorant towards the containing space of the body.

DETAILED DESCRIPTION OF THE PREFERRED EMBODIMENTS

The technical characteristics of the present invention will become apparent with the detailed description of the preferred embodiments and the illustration of the related drawings.

Figure 1:
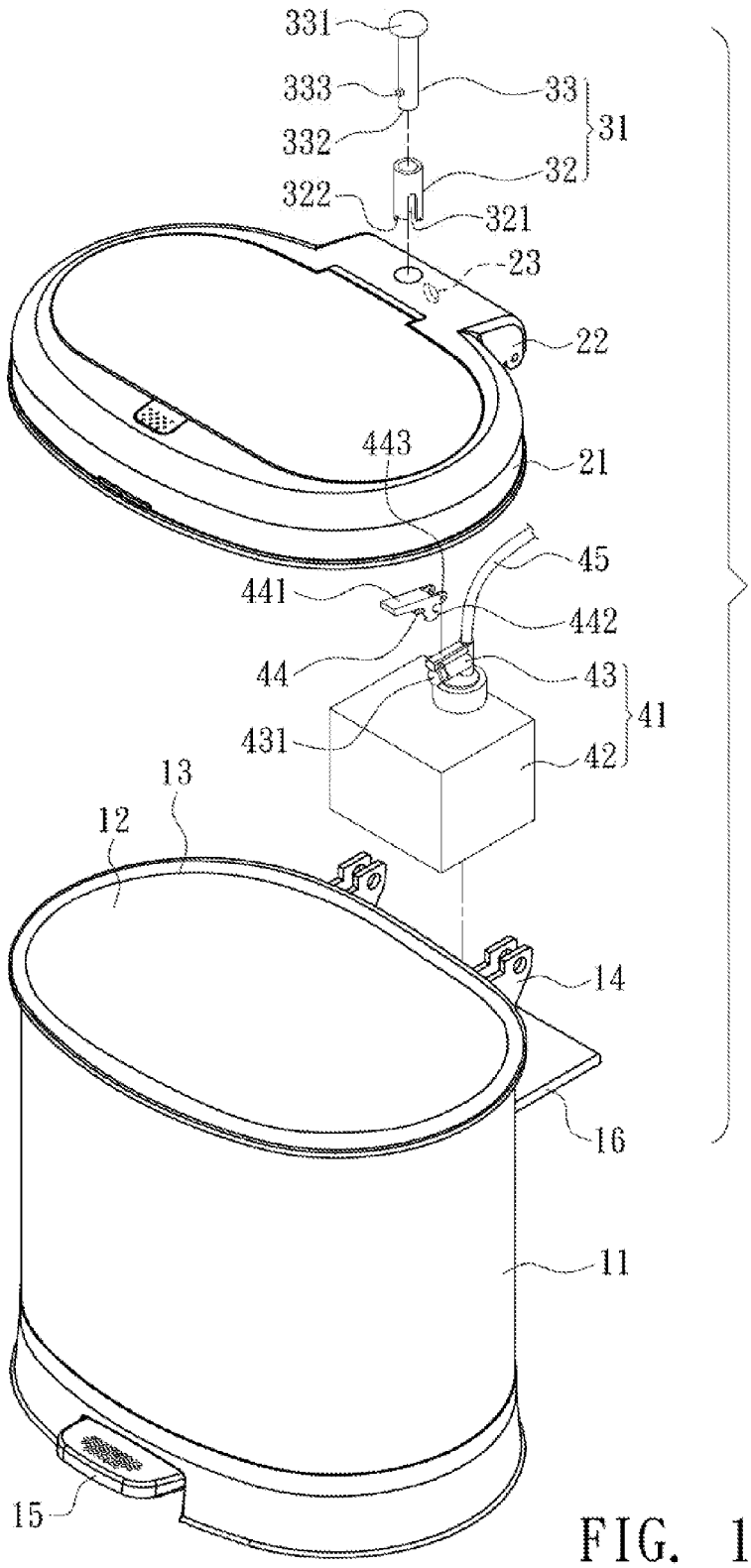
FIG. 1 is an exploded view of the present invention.
Figure 2:
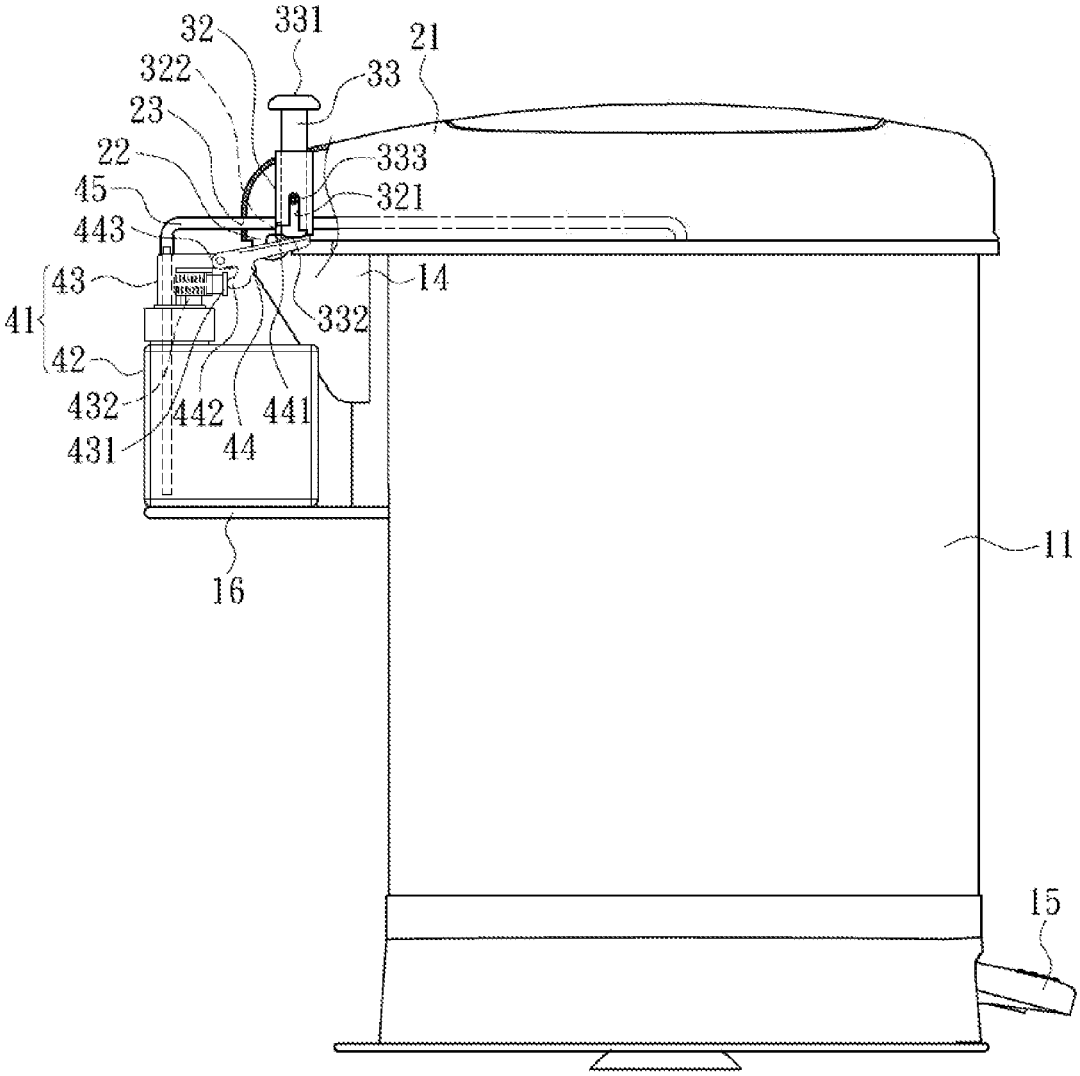
FIG. 2 is a schematic view of a planar structure of the present invention.

With reference to FIGS. 1 and 2 for a trash can with a deodorizing mechanism of the present invention, the trash can with a deodorizing mechanism comprises a body 11, a lid 21, a pressing element 31 and a deodorizing mechanism 41.

The body 11 is hollow and includes a containing space 12 for containing trashes, an opening 13 formed at the top of the body 11 and interconnected to the containing space 12, and a pivotal connecting base 14 disposed on an external side of the top of the body 11.

The lid 21 includes a pivot portion 22 disposed on a side of the external periphery of the lid 21, and the lid 21 is pivotally coupled to the pivotal connecting base 14 at the top of the body 11 through the pivot portion 22 for performing an opening or closing movement to the opening 13 of the body 11. In this preferred embodiment, a foot pedal 15 is installed at the bottom of the body 11, and the foot pedal 15 is coupled to the lid 21 through a lid rod module (not shown in the figure), such that the foot pedal 15 can be pressed by a user's foot to open or close the lid 21 (since the aforementioned method is a prior art and thus the detailed structure and its operating principle will not be described here). In addition, the lid 21 is comprised of a pressing element 31 longitudinally extended and installed into a bushing 32 of the lid 21 and a press rod 33 passed into the bushing 32, and the bottom edge of the bushing 32 is substantially in an L-shape and includes a long slot section 321 and a short slot section 322 to constitute a groove, and the internal periphery of the lid 21 further includes a through hole 23 interconnected to an external space.

An end of the press rod 33 facing upward is extended from the exterior of the lid 21 to form a pressing end 331, and another end of the press rod 33 facing downward is defined as a pressed end 332, and the press rod 33 further includes a protrusion 333 selectively passed into a long slot section 321 or short slot section 322 of the bushing 32.

The deodorizing mechanism 41 is mounted onto a frame 16 installed on an external side of the body 11 and the deodorizing mechanism 41 is comprised of a bottle 42 filled with a deodorant and a nozzle 43 installed to the bottle 42, and the nozzle 43 includes an actuating element 44 for controlling the operation of the nozzle 43, wherein the nozzle 43 of this preferred embodiment includes a start button 431 elastically propped by an elastic body 432 to provide a restoring elasticity, and a propping portion 441 is formed at an end of the actuating element 44 and an actuating portion 442 is formed at another end and bent in a direction towards the start button 431, and a pivotal connecting portion 443 is formed between the propping portion 441 and the actuating portion 442, and the actuating element 44 is pivotally coupled to the nozzle 43 through the pivotal connecting portion 443, and the actuating portion 442 of the actuating element 44 is abutted against the start button 431 of the nozzle 43, such that the actuating element 44 can receive an action force of the elastic body 432 indirectly to provide a restoring elasticity. When the lid 21 is closed and covered onto the opening 13 of the body 11, the propping portion 441 of the actuating element 44 is abutted against the pressed end 332 of the press rod 33, and an end of a pipe 45 is connected to a nozzle opening of the nozzle 43, and another end of the pipe 45 is passed from the external space through the through hole 23 of the lid 21 and installed at the bottom of an internal periphery of the lid 21.

Figure 3:
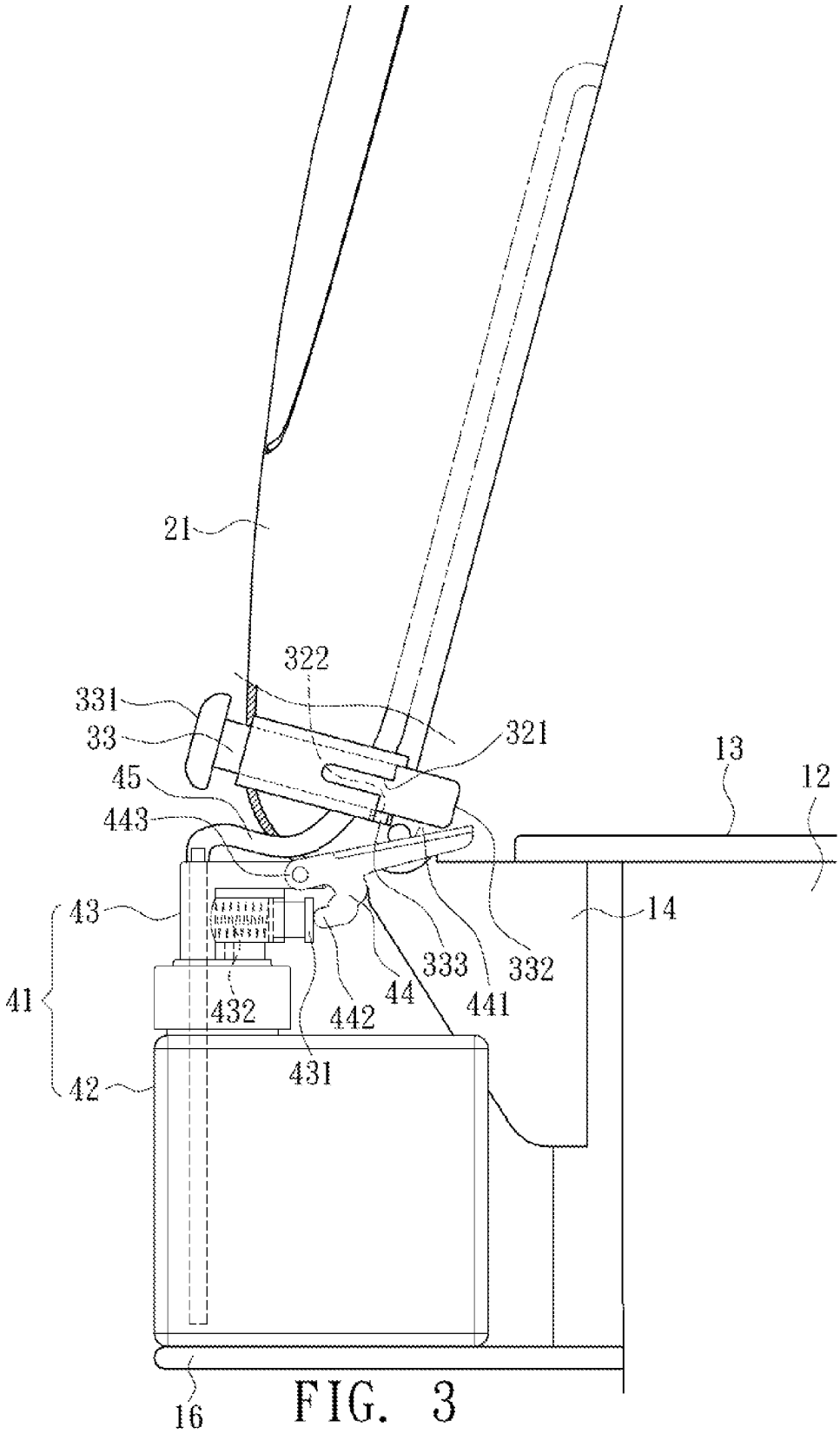
FIG. 3 is a schematic view of an application status of the present invention, showing that a protrusion of a pressing element is passed into a short slot section of a bushing.
Figure 4:
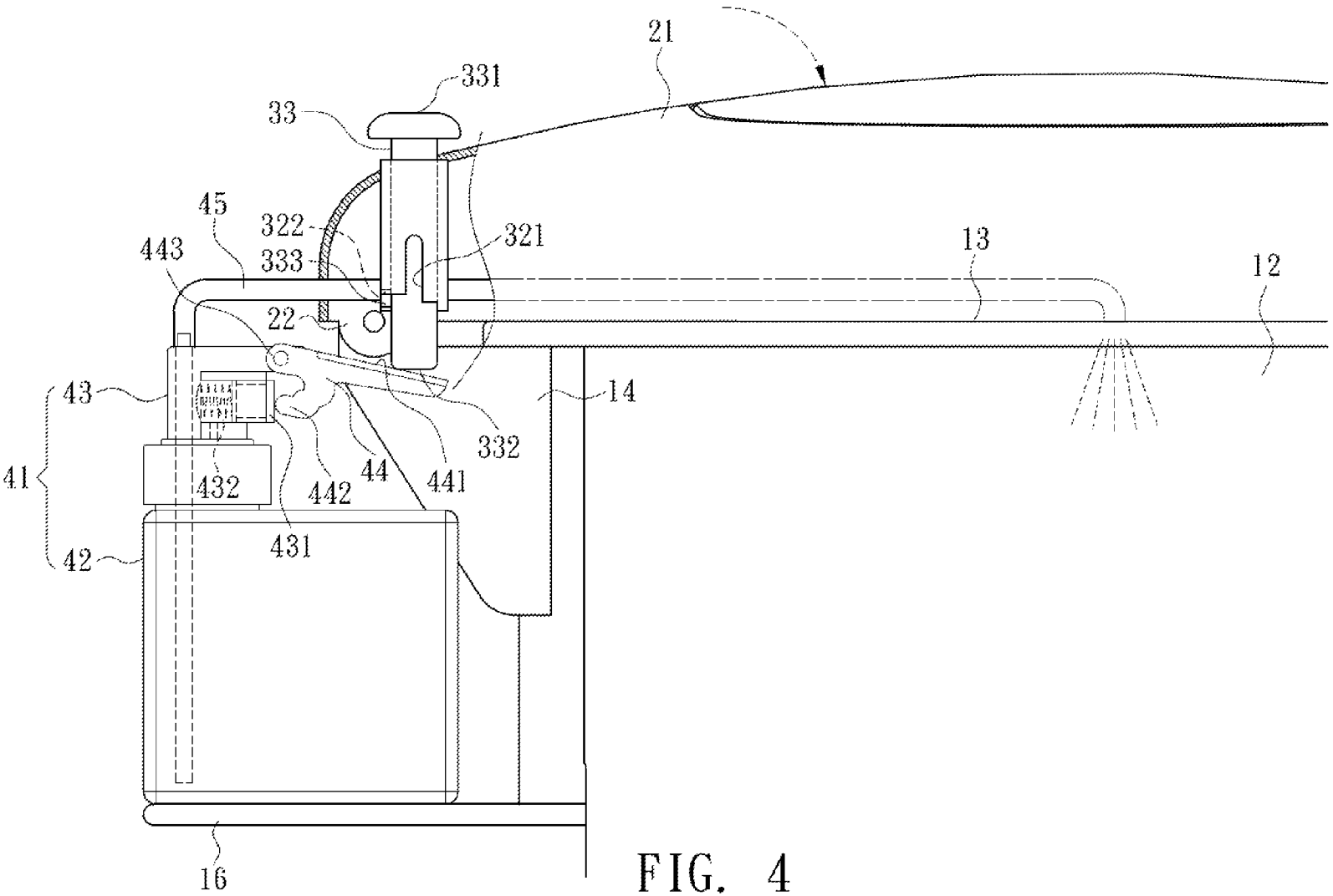
FIG. 4 is a schematic view of an application status of the present invention, showing that a protrusion of a pressing element is passed into a short slot section of a bushing, and a lid is closed.

In a practical application of the present invention comprising the aforementioned components as shown in FIG. 3, a user can rotate the press rod 33 of the pressing element 31, such that the protrusion 333 of the press rod 33 is passed and latched into the short slot section 322 of the bushing 32. Now, the pressed end 332 of the press rod 33 is protruded from the bottom of the bushing 32. If the lid 21 is closed and covered onto the opening 13 of the body 11 as shown in FIG. 4, the pressed end 332 of the press rod 33 will press the propping portion 441 of the actuating element 44 accordingly, such that the actuating portion 442 at another end of the actuating element 44 will press the start button 431 of the nozzle 43 due to the pivotal swinging movement, and the nozzle 43 will suck the deodorant stored in the bottle 42 and spray the deodorant along the pipe 45 towards the containing space 12 of the body 11. Therefore, the present invention can provide the function of automatically spraying the deodorant to achieve the deodoration and disinfection effects when the lid 21 is closed and covered onto the opening 13 of the body 11. Since the method of sucking the deodorant by the nozzle is a prior art, therefore the related operating principle will not be described here. When the lid 21 is closed and covered onto the opening 13 of the body 11, the elastic body 432 is compressed to produce an elastic damping action to effectively reduce a collision force produced between the lid 21 and the body 11 during the closing movement of the lid 21.

Figure 5:
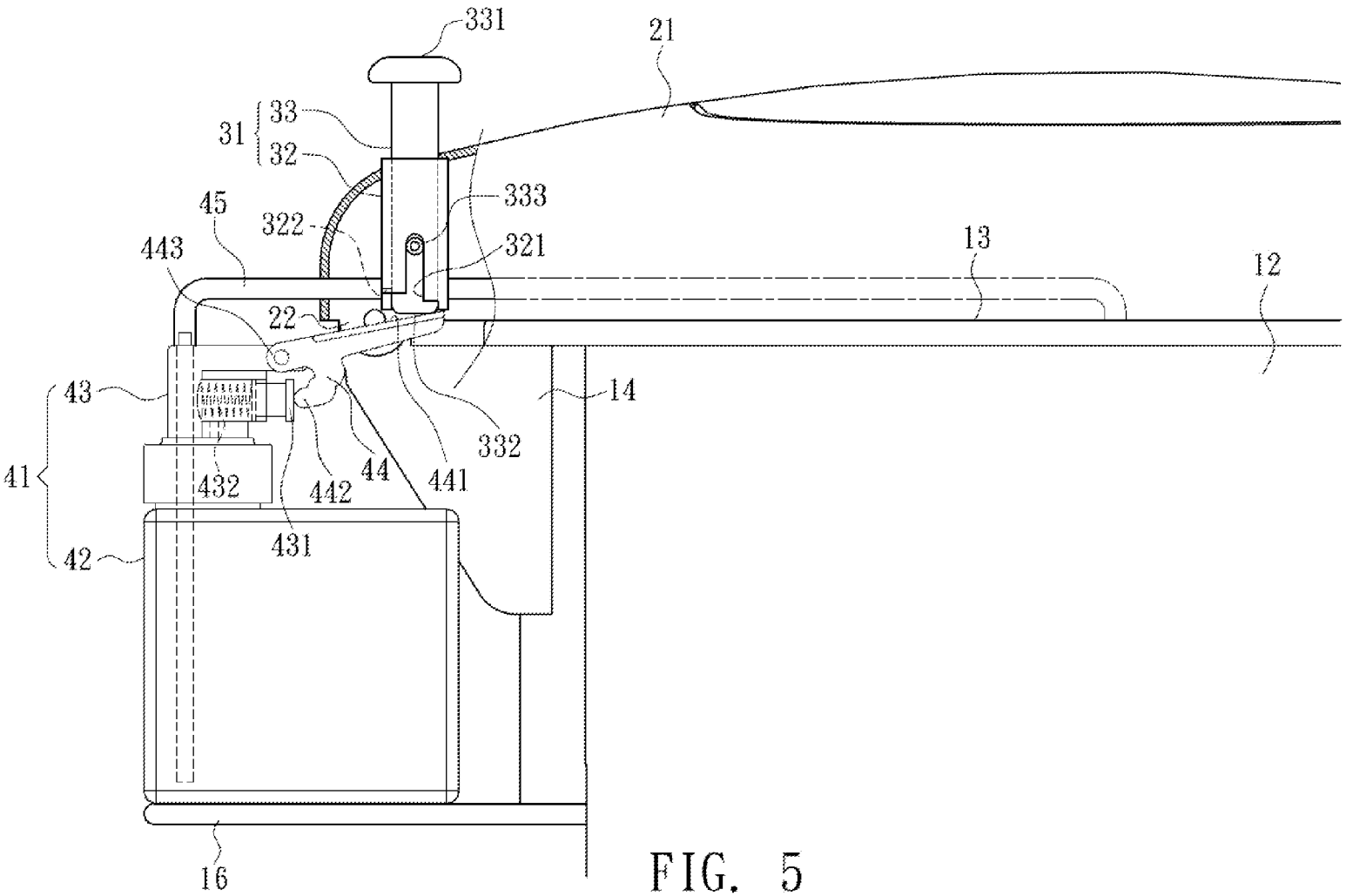
FIG. 5 is a schematic view of an application status of the present invention, showing that a protrusion of a pressing element is passed into a long slot section of a bushing, and a lid is closed.
Figure 6:
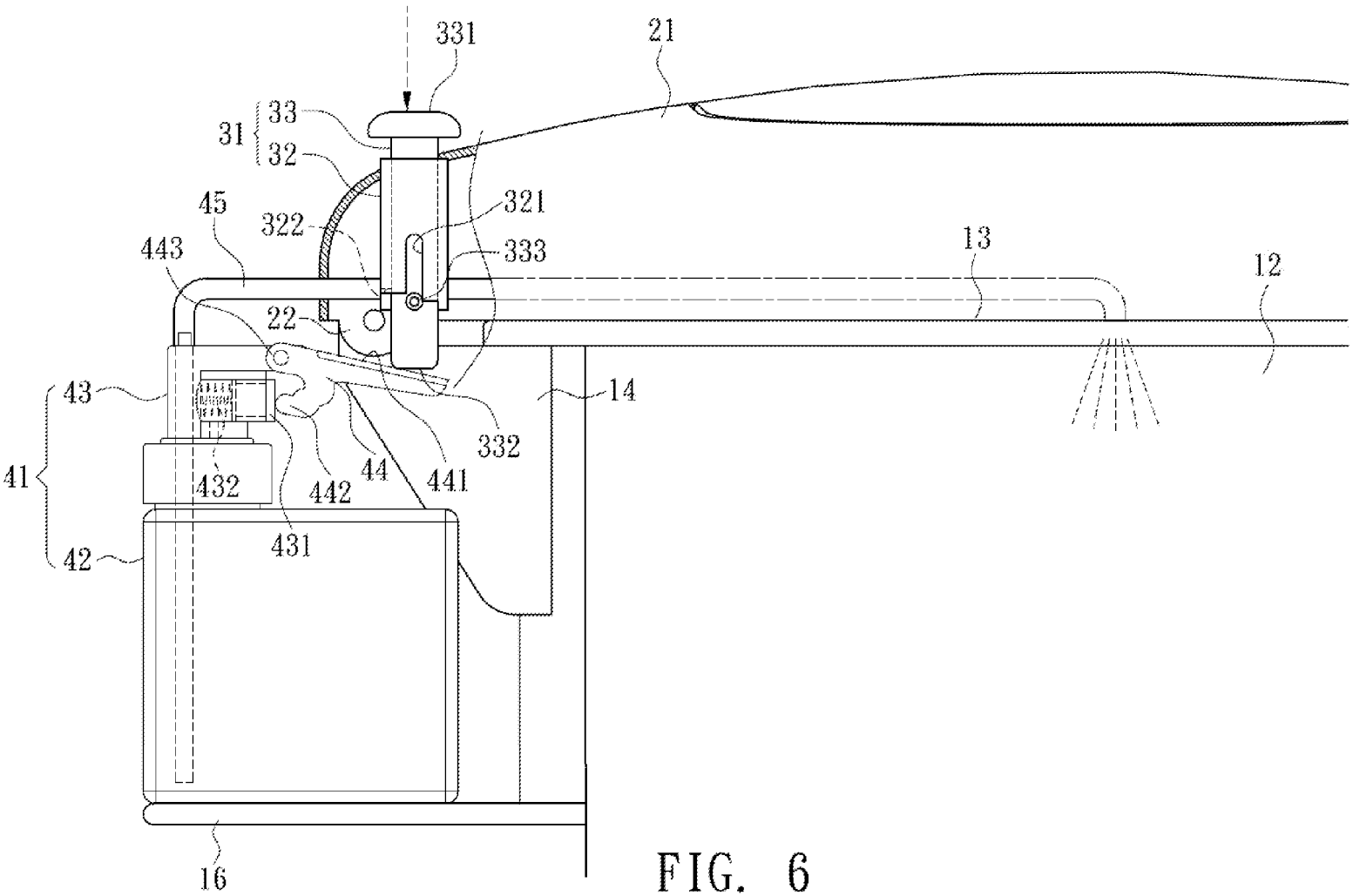
FIG. 6 is a schematic view of an application status of the present invention, showing that a press rod of a pressing element is pressed manually.

In FIG. 5, if a user rotates the press rod 33, the protrusion 333 of the press rod 33 can be passed into the long slot section 321 of the bushing 32, such that if the lid 21 is closed and covered onto the opening 13 of the body 11, the press rod 33 will prop the propping portion 441 of the actuating element 44 to slide along the long slot section 321 of the bushing 32, so that the nozzle 43 will not be turned on for the action of spraying deodorants. However, if the lid 21 is closed and covered onto the opening 13 of the body 11 as shown in FIG. 6, a user can press the press rod 33 of the pressing element 31 manually to press the actuating portion 442 at another end of the actuating element 44 so as to start the start button 431 of the nozzle 43, so that the nozzle 43 can suck the deodorant stored in the bottle 42 and spray the deodorant along the pipe 45 towards the containing space 12 of the body 1. Therefore, the prevent invention provides a way of spraying deodorant manually.

In summation, the present invention has the following advantages:

1. A deodorant can be sprayed when the lid 21 is closed and covered onto the opening 13 of the body 11. If the lid 21 is closed and covered onto the opening 13 of the body 11, the elastic body 432 will be compressed, and thus the present invention can spray the deodorant while providing the effect of slowing down the closing movement of the lid 21.

2. The protrusion 333 of the press rod 33 can be selectively passed into the long slot section 321 or the short slot section 322 of the bushing 32, such that the present invention can switch is operation to the deodorizing mode automatically or manually according to a user's preference or using habit.

3. When the lid 21 is closed and covered onto the opening 13 of the body 11, the deodorant can be sprayed into the containing space 12 of the body 11 but not at places outside the containing space 12, and thus the deodoration can be applied to the exact position of the containing space 12 to achieve the deodoration and disinfection effects.

4. The present invention comes with a simple structure, a low manufacturing cost, and a quick and convenient assembling procedure, and the deodorizing mechanism 41 is mounted onto the frame 16 installed on an external side of the body 11, so that the trash storage volume of the body 11 will not be reduced.

What is claimed is:

1. A trash can with a deodorizing mechanism, comprising:

a body, having a containing space therein, and an opening formed at the top of the body and interconnected to the containing space;

a lid, having a pivot portion pivotally coupled to an appropriate position at the top of the body and capable of opening or closing the opening of the body, and a pressing element installed to the lid;

a deodorizing mechanism, mounted onto the body and comprised of a bottle containing a deodorant and a nozzle installed to the bottle, and the nozzle including an actuating element for controlling an operation of the nozzle, and the actuating element propped by an elastic body for providing a restoring elasticity, such that if the lid is closed and covered onto the opening of the body, the pressing element will press against the actuating element to compress the elastic body, and the nozzle will suck the deodorant stored in the bottle and spray the deodorant towards the containing space of the body, and if the lid is closed and covered onto the opening of the body, the actuating element will compress the elastic body to slow down the closing movement of the lid.

2. The trash can with a deodorizing mechanism as recited in claim 1, wherein the nozzle includes a start button, and the elastic body is provided for propping the start button, and the actuating element includes a propping portion formed at an end of the actuating element, an actuating portion formed at another end of the actuating element, and a pivotal connecting portion formed between the propping portion and the actuating portion, and the actuating element is pivotally coupled to the nozzle through the pivotal connecting portion, and the actuating portion of the actuating element is provided for pressing the start button of the nozzle, such that when the lid is closed and covered onto the opening of the body, the propping portion of the actuating element is pressed by the pressing element, and the actuating portion of the actuating element is pressed against the start button to compress the elastic body.

3. The trash can with a deodorizing mechanism as recited in claim 1, wherein the pressing element is comprised of a bushing installed in the lid, and a press rod passed into the bushing, and the bushing includes a long slot section and a short slot section formed thereon, and an end of the press rod is extended outside the lid to form a pressing end, and another end is defined as a pressed end, and the press rod includes a protrusion selectively passed into the long slot section or the short slot section of the bushing, thereby if the protrusion of the press rod is selectively passed into the short slot section of the bushing, and the lid is closed and covered onto the opening of the body, the pressed end of the press rod will synchronously press the actuating element, and the nozzle will suck the deodorant stored in the bottle and spray the deodorant towards the containing space of the body, and if the protrusion of the press rod is selectively passed into the long slot section of the bushing, and after the lid is closed and covered onto the opening of the body, the pressing end of the press rod can be pressed manually to press the actuating element, such that the nozzle can suck the deodorant stored in the bottle and spray the deodorant towards the containing space of the body.

4. The trash can with a deodorizing mechanism as recited in claim 3, wherein the long slot section and the short slot section of the bushing constitute a substantially L-shaped groove.

5. The trash can with a deodorizing mechanism as recited in claim 1, further comprising a frame installed on an external side of the body, and the deodorizing mechanism is mounted onto the frame at the external side of the body.

6. The trash can with a deodorizing mechanism as recited in claim 1, wherein the lid further includes a through hole formed at an internal periphery of the lid and interconnected to an external space, and the nozzle further includes a pipe with an end connected to a nozzle opening of the nozzle, and another end passed from the external space through the through hole of the lid and installed at the bottom of the internal periphery of the lid.

* * * * *